US007109657B2

(12) United States Patent
Chien et al.

(10) Patent No.: US 7,109,657 B2
(45) Date of Patent: Sep. 19, 2006

(54) PLASMA DISPLAY PANEL UTILIZING DIFFERENT ELECTRODE PAIR AREAS TO CONTROL COLOR TEMPERATURE

(75) Inventors: Yu-Ting Chien, Taipei Hsien (TW); Jih-Fon Huang, Hsin-Chu Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 192 days.

(21) Appl. No.: 10/249,477

(22) Filed: Apr. 14, 2003

(65) Prior Publication Data

US 2004/0222741 A1 Nov. 11, 2004

(30) Foreign Application Priority Data

Aug. 9, 2002 (TW) ..... 91118044 A

(51) Int. Cl.
*H01J 1/62* (2006.01)

(52) U.S. Cl. ..... 313/585; 313/582

(58) Field of Classification Search ..... 313/582, 313/583, 584, 585, 586
See application file for complete search history.

(56) References Cited

U.S. PATENT DOCUMENTS 5,587,624 A * 12/1996 Komaki ..... 313/584
5,838,105 A * 11/1998 Mitomo ..... 313/582
6,097,357 A * 8/2000 Shinoda et al. ..... 345/63
6,195,070 B1 * 2/2001 Shinoda et al. ..... 345/60
6,333,599 B1 * 12/2001 Kawanami et al. ..... 313/582
6,348,762 B1 * 2/2002 Nunomura et al. ..... 313/582
6,373,195 B1 * 4/2002 Whang et al. ..... 315/169.3
6,541,913 B1 * 4/2003 Mori et al. ..... 313/582
6,936,966 B1 * 8/2005 Kanazawa et al. ..... 313/584

FOREIGN PATENT DOCUMENTS

CN 1330386 A 1/2002
JP P2000-123748 A 4/2000

* cited by examiner

*Primary Examiner*—Karabi Guharay
*Assistant Examiner*—Dalei Dong
(74) *Attorney, Agent, or Firm*—Winston Hsu

(57) ABSTRACT

A plasma display panel includes a rear plate, a front plate formed parallel with and spaced apart from the rear plate, a plurality of electrode pairs, and a plurality of data electrodes. Each electrode pair includes a first transparent electrode and a second transparent electrode formed in parallel on a bottom surface of the front plate. Each data electrode is formed in parallel on a top surface of the rear plate and is orthogonal to each electrode pair. A plurality of display cells is defined at an intersection of each data electrode and each electrode pair. The plurality of display cells include at least a first display cell, a second display cell, and a third display cell for displaying three different colors. At least one recessed portion is formed in the electrode pairs in the second display cell and the third display cell.

16 Claims, 8 Drawing Sheets

PLASMA DISPLAY PANEL UTILIZING DIFFERENT ELECTRODE PAIR AREAS TO CONTROL COLOR TEMPERATURE

BACKGROUND OF INVENTION

1. Field of the Invention

The present invention generally relates to a plasma display panel (PDP), and more particularly, to a plasma display panel that can adjust color temperature by utilizing area of an electrode pair.

2. Description of Related Art

Plasma display panels (PDPs) have been gradually applied to large sized displaying apparatuses. The light source comes from plasma, which is initiated by electrodes, to produce ultraviolet rays. When the ultraviolet rays shine incident on different fluorescent materials, the fluorescent materials will emit visible lights having different wavelengths.

Referring to FIG. 1, it is a schematic diagram of a plasma display panel 10 according to the prior art. The prior art plasma display panel 10 comprises a housing (not shown), a rear plate 12, and a front plate 14 disposed parallel with and spaced apart from the rear plate 12. A plurality of electrode pairs 16 are disposed on a bottom surface of the front plate 14.

Each electrode pair 16 comprises a common electrode 17 and a scanning electrode 18. A dielectric layer 20 is disposed on the bottom surface of the front plate 14 to cover the electrode pairs 16 so as to protect the electrode pairs 16. A protective layer 22 composed of magnesium oxide (MgO) is disposed underneath the dielectric layer 20 to protect the dielectric layer 20 from being degraded due to sputtering. A plurality of barrier ribs 24 are disposed on the rear plate 12. A plurality of data electrodes 26 are disposed between two adjacent barrier ribs 24. Three different fluorescent materials, including blue, red, and green fluorescent materials 30B, 30R, 30G are filled between two adjacent barrier ribs 24. The space between two adjacent barrier ribs 24 is filled with a discharge gas. The top ends of the plurality of barrier ribs 24 are fixed to a bottom surface of the protective layer 22 to isolate the plasma at either side of the barrier ribs 24 so as to avoid the cross-talk problem.

Each of the common electrodes 17 and the scanning electrodes 18 respectively comprises a sustaining electrode 36 and a bus electrode 38. The sustaining electrode 36, usually made of indium tin oxide (ITO), is a wide transparent conductor and is used for initiating and sustaining the discharge. The bus electrode 38, usually made of a Chrome/Copper/Chrome (Cr/Cu/Cr) metal alloy, is a narrow and non-transparent metal line. The bus electrode 38, being in parallel with the sustaining electrode 36, is disposed on a surface of the sustaining electrode 36 to assist the sustaining electrode 36 with initiating discharge and reducing the resistance of the common electrode 17 and the scanning electrode 18. As shown in FIG. 1, a plurality of display cells, partitioned by two adjacent barrier ribs 24, are defined at an intersection of each data electrode 26 and each electrode pair 16. Each display cell comprises a first display cell 32B for displaying blue light, a second display cell 32R for displaying red light, and a third display cell 32G for displaying green light.

When a voltage is applied between the electrode pair 16 and the data electrode 26 in each display cells 32B, 32R, 32G, an electric field is generated between the electrode pair 16 and the data electrode 26 to initiate discharge so as to produce ultraviolet rays. When the ultraviolet rays shine incident on different fluorescent materials 30B, 30R, 30G, the fluorescent materials will emit lights. The factors affecting the luminous efficiency of each of the display cells 32B, 32R, 32G include the kind of the discharging gas, the material of the electrode, and the luminous efficiency of the fluorescent material.

In order to improve the luminescent quality of the plasma display panel 10, the color temperature of the plasma display panel 10 should be increased. However, the luminous efficiency of the green fluorescent material 30G is the highest one, the luminous efficiency of the blue fluorescent material 30B is the lowest one, and the luminous efficiency of the red fluorescent material 30R is in between. Under the same situation, the luminosity of the display cells 32B, 32R, 32G is different from each other so that an inhomogeneous problem is incurred. Therefore, the color temperature of the plasma display panel 10 is not able to be increased.

Referring to FIG. 2, it is a schematic diagram of another plasma display panel 40 according to the prior art. The major difference between the plasma display panel 40 and the plasma display panel 10 is the space between the adjacent barrier ribs 44. The barrier ribs 24 of the plasma display panel 10 are arranged with an equal space, while the barrier ribs 44 of the plasma display panel 40 are not arranged with an equal space. As shown in FIG. 2, the space covered by the blue fluorescent material 30B is the widest one, the space covered by the red fluorescent material 30R is the narrowest one, and the space covered by the green fluorescent material 30G is in between. Since the wider space is covered by more fluorescent materials, the luminosity of the display cells 32B, 32R, 32G in the plasma display panel 40 becomes homogeneous by adjusting the luminous efficiency of each of the fluorescent material 30B, 30R, and 30G so as to increase the color temperature.

Due to the unequal space between the barrier ribs 44 in the plasma display panel 40, some of the spaces between the adjacent barrier ribs 44 need to be made smaller in comparison with the space between the adjacent barrier ribs 24 in the plasma display panel 10, which has a same resolution as the plasma display panel 40. That means the manufacturing accuracy needs to be improved to fabricate the barrier ribs 44 with smaller space. Generally speaking, the space covered by the blue fluorescent material 30B needs to be 20% larger than the space covered by the green fluorescent material 30G and the space covered by the red fluorescent material 30R to obviously increase the color temperature. Since the resolution of the plasma display panel is continuously increased, this method provides difficulty in manufacturing. Furthermore, because the discharge space for the second display cell 32R in the plasma display panel 40 is shrunk greatly to reduce the luminosity of the red light emitted from the second display cell, the luminous efficiency of the plasma display panel 40 is reduced. In addition, due to the unequal space between the barrier ribs 44 in the plasma display panel 40, the discharge space for the first display cell 32B, the second display cell 32R, and the third display cell 32G is thus different from each other, resulting in an unmatched operational voltage margin problem.

SUMMARY OF INVENTION

It is an object of the present invention to provide a plasma display panel having different electrode pair areas to increase the color temperature of the plasma display panel and to avoid the above-mentioned problems.

According to one aspect of the present invention, a plasma display panel comprises a rear plate, a front plate disposed parallel with and spaced apart from the rear plate, a plurality of electrode pairs, and a plurality of data electrodes. Each electrode pair comprises a first transparent electrode and a second transparent electrode disposed in parallel on a bottom surface of the front plate. Each data electrode is disposed in parallel on a top surface of the rear plate and is orthogonal to each electrode pair. A plurality of display cells is defined at an intersection of each data electrode and each electrode pair. The plurality of display cells comprise at least a first display cell, a second display cell, and a third display cell for displaying three different colors. At least one recessed portion is formed in the electrode pairs in the second display cell and the third display cell.

In a plasma display panel according to the present invention, a recessed portion is formed in the electrode pairs in the display cells for emitting red light and green light to decrease the discharge areas for the electrode pairs in the display cells for emitting red light and green light. Therefore, the luminosity of the red light and the green light emitted from these display cells is reduced to increase the color temperature of the plasma display panel. Furthermore, regarding the manufacturing accuracy problem that is difficult to be overcome, the problem of reduced luminous efficiency and the discrepancy problem of the operational voltage are avoided.

These and other objectives of the present invention will become apparent to those of ordinary skill in the art after having read the following detailed description of the preferred embodiments illustrated in the various drawings.

DETAILED DESCRIPTION

Figure 1:
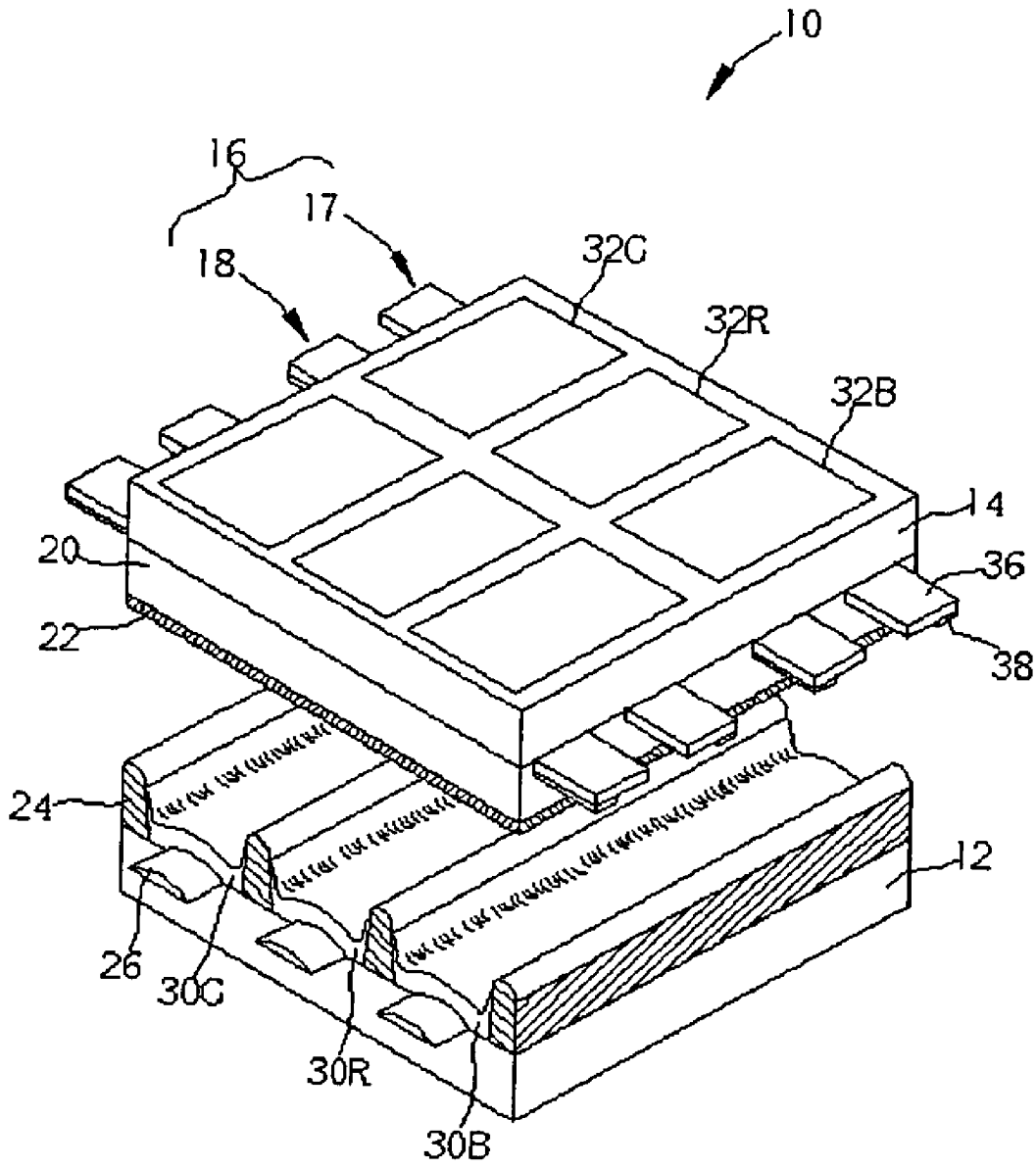
Fig. 1 Prior art
FIG. 1 is a schematic diagram of a plasma display panel according to the prior art.
Figure 2:
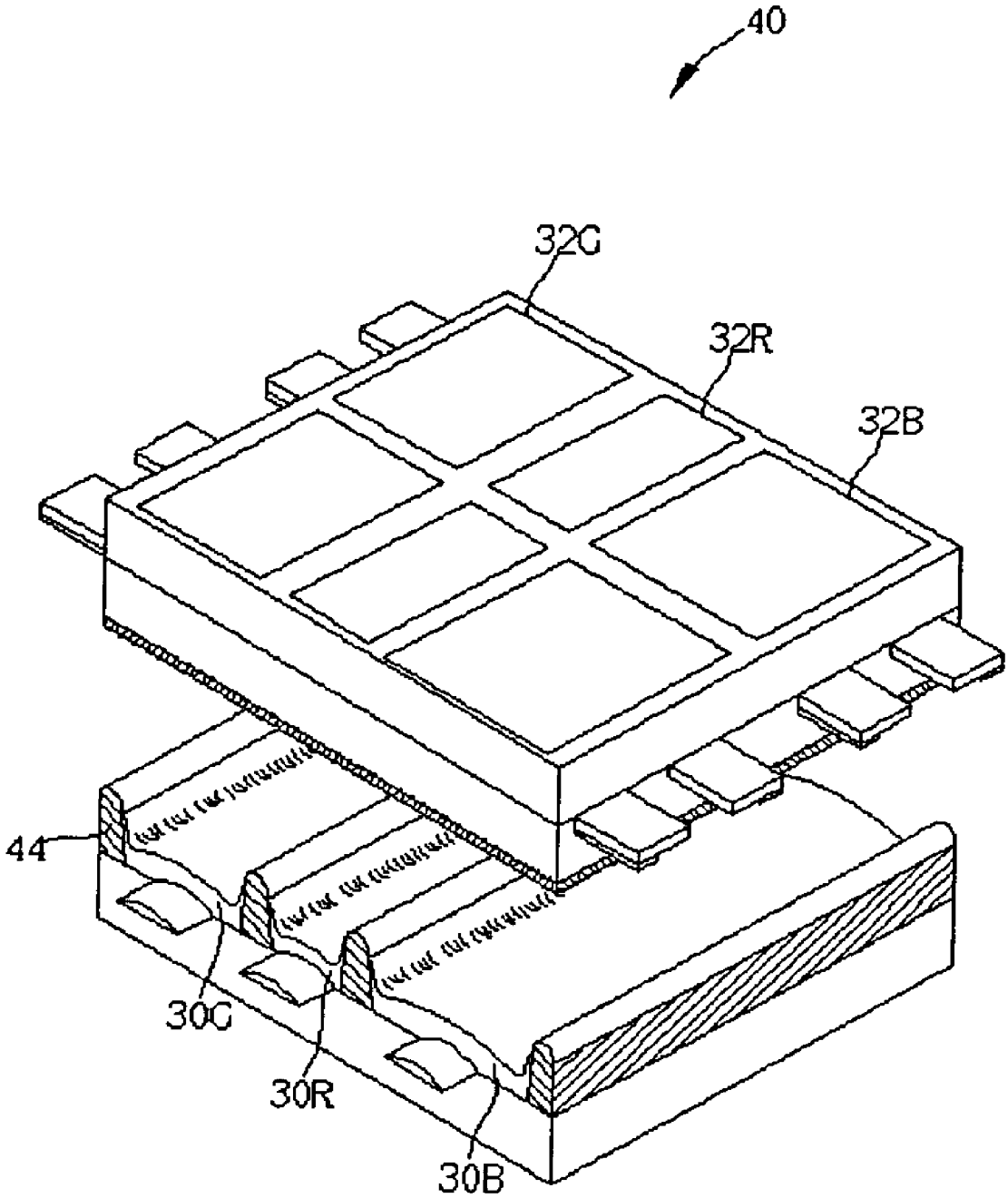
Fig. 2 Prior art
FIG. 2 is a schematic diagram of another plasma display panel according to the prior art.
Figure 3:
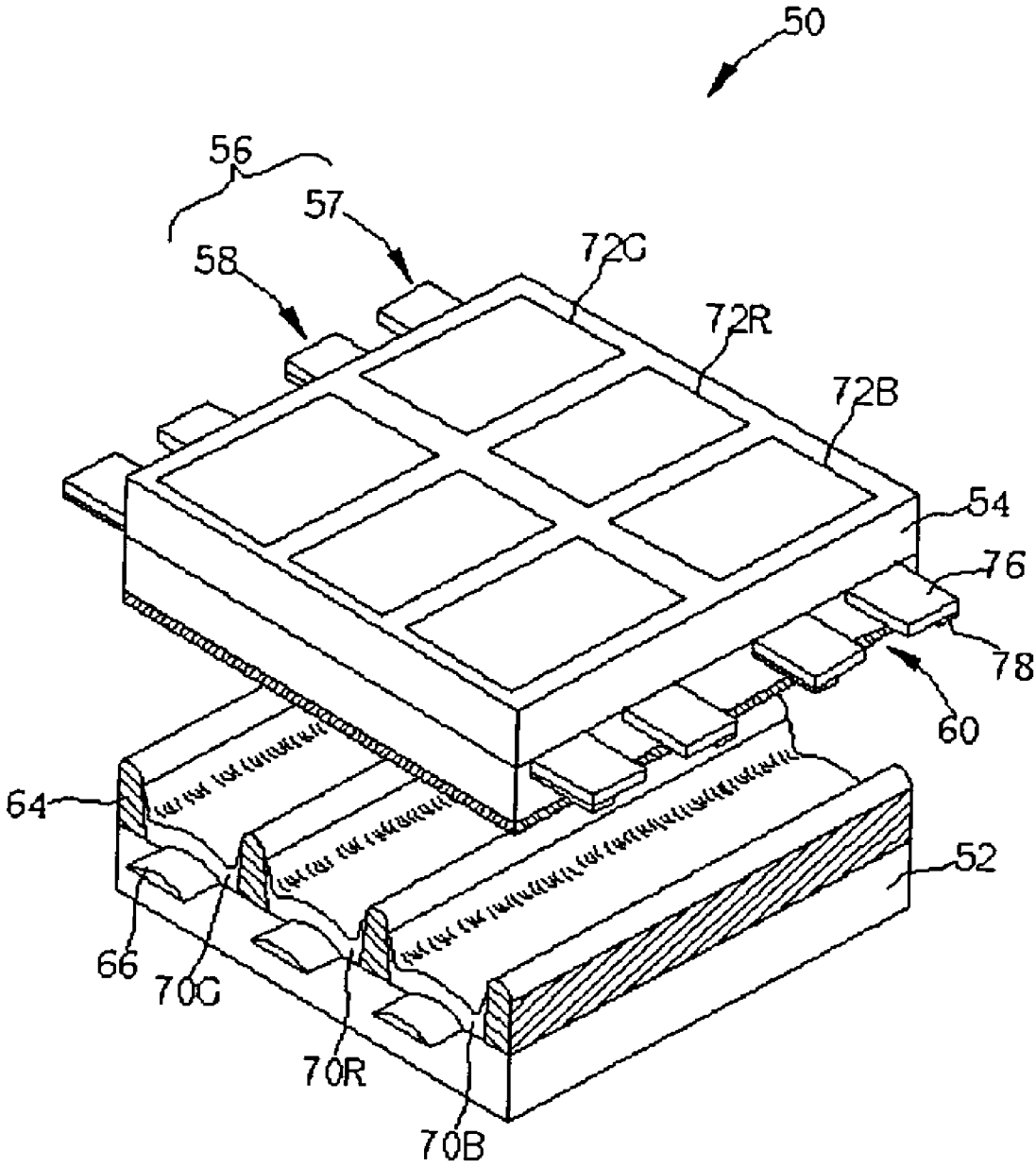
FIG. 3 is a schematic diagram of a plasma display panel according to the present invention.

The present invention provides a plasma display panel having increased color temperature by utilizing different electrode pair areas. Referring to FIG. 3, FIG. 3 is a schematic diagram of a plasma display panel 50 according to the present invention. The components in the plasma display panel 50 and the material compositions of the plasma display panel 50 are the same as the prior art plasma display panel 10 shown in FIG. 1. As shown in FIG. 3, the plasma display panel 50 comprises a rear plate 52, and a front plate 54 disposed parallel with and spaced apart from the rear plate 52. A plurality of electrode pairs 56 are disposed in parallel on a bottom surface of the front plate 54 along a first direction. A plurality of data electrodes 66 and a plurality of barrier ribs 64 are disposed in parallel on a top surface of the rear plate 52 along a second direction. The plurality of data electrodes 66 are spaced from each other by a predetermined distance, and the plurality of barrier ribs 64 are spaced from each other by a predetermined distance. The first direction is orthogonal to the second direction.

Each electrode pair 56 comprises a common electrode 57 and a scanning electrode 58. Each of the common electrodes 57 and the scanning electrodes 58 respectively comprises a sustaining electrode 76, made of transparent indium tin oxide (ITO), and a bus electrode 78, made of a non-transparent metal material. A discharge gap 60 is thus formed between the common electrode 57 and the scanning electrode 58. Furthermore, a plurality of display cells is defined at an intersection of each data electrode 66 and each electrode pair 56. Each display cell is partitioned by two adjacent barrier ribs 64. A fluorescent material is coated on the surfaces of the rear plate 52 and the adjacent barrier ribs 64 in each display cell respectively to emit individual monochromatic light. Each display cell comprises a first display cell 72B, a second display cell 72R, and a third display cell 72G. The first display cell 72B is coated with the fluorescent material 70B for displaying blue light, the second display cell 72R is coated with the fluorescent material 70R for displaying red light, and the third display cell 72G is coated with the fluorescent material 70G for displaying green light.

In contrast to the prior art plasma display panel 10, a plurality of recess portions are fanned in the electrode pair 56 in the second display cell 72R or in the third display cell 72G in the present invention plasma display panel 50, and the recess portion is not formed in the electrode pair 56 in the first display cell 72B. In order to explain the features of the present invention thoroughly, a top view figure of the plasma display panel 50 is adapted for describing the preferred embodiments of the present invention plasma display panel 50.

Figure 4:
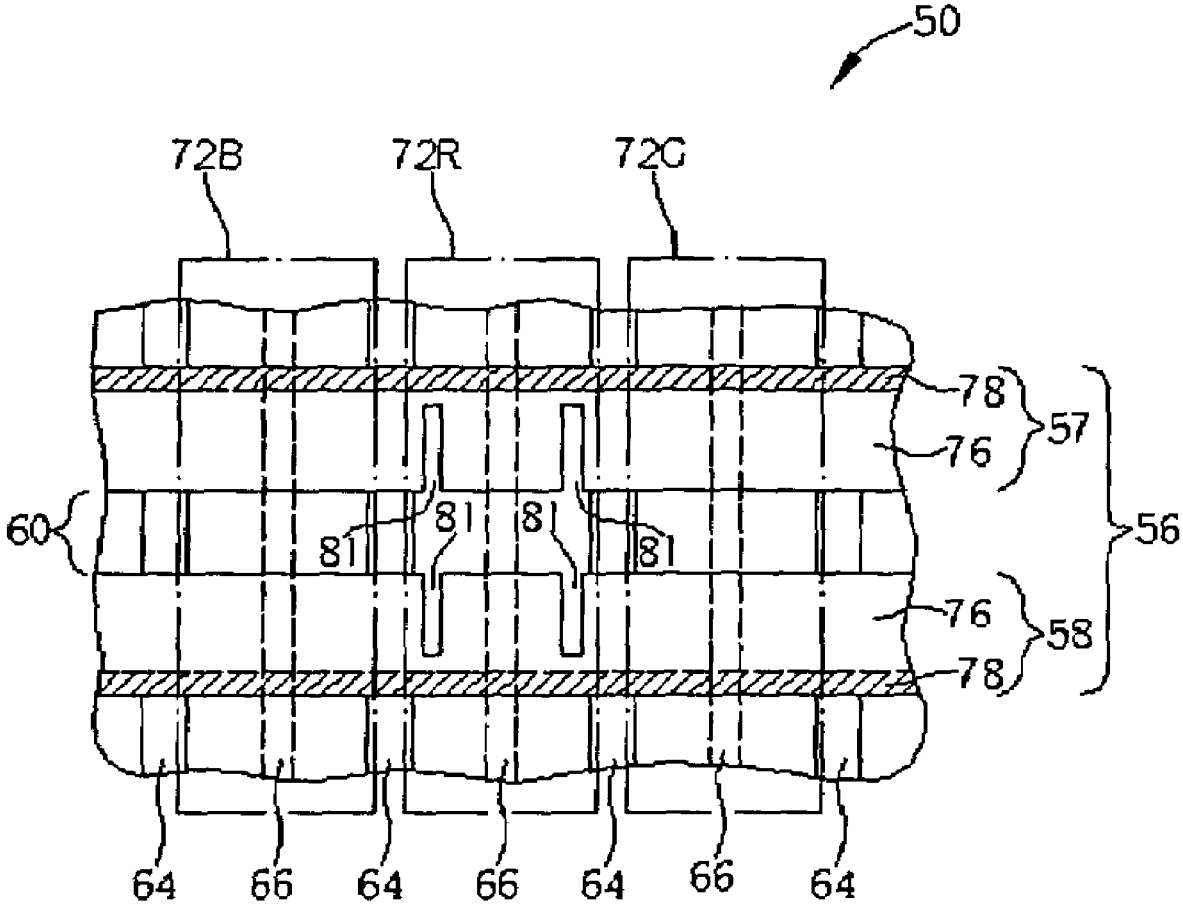
FIG. 4 is a top view of a plasma display panel according to the first preferred embodiment of the present invention.

As shown in FIG. 4, four recessed portions 81 are formed in the electrode pair 56 in the second display cell 72R according to the first preferred embodiment of the present invention. Each recessed portion 81, extending from one side of the discharge gap 60 along the second direction, is formed inside the transparent sustaining electrode 76 at either side of the common electrode 57 and the scanning electrode 58 nearby the barrier ribs 64 of the second display cell 72R. The discharge area for the electrode pair 56 in the second display cell 72R is thus decreased to reduce the luminosity of the red light emitted from the second display cell 72R. Hence the color temperature of the plasma display panel 50 is increased.

Figure 5:
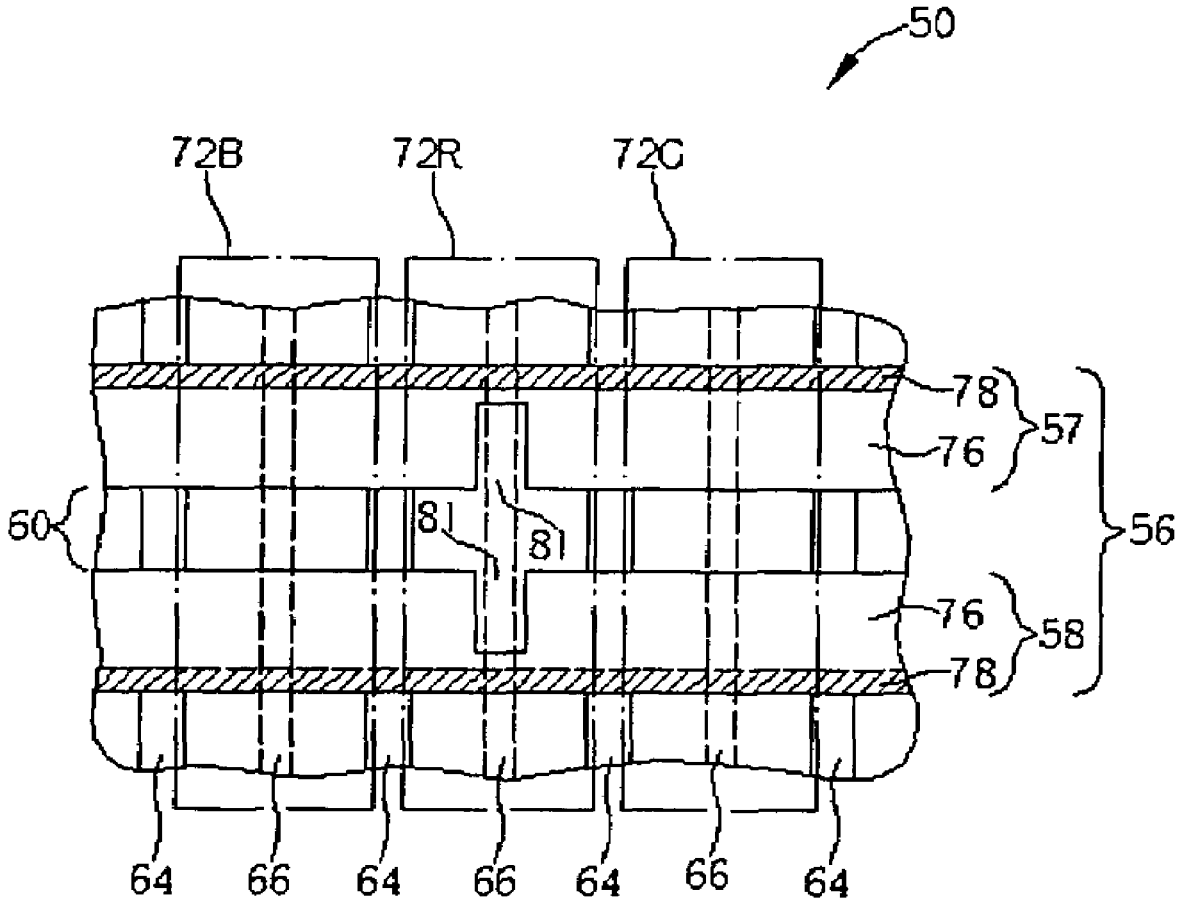
FIG. 5 is a top view of a plasma display panel according to the second preferred embodiment of the present invention.

As shown in FIG. 5, two recessed portions 81 are formed in the electrode pair 56 in the second display cell 72R according to the second preferred embodiment of the present invention. Each recessed portion 81, extending from one side of the discharge gap 60 along the second direction, is formed inside the transparent sustaining electrode 76 between the common electrode 57 and the scanning electrode 58 approximately above the data electrode 66. The discharge area for the electrode pair 56 in the second display cell 72R is thus decreased to reduce the luminosity of the red light emitted from the second display cell 72R so that the color temperature of the plasma display panel 50 is increased.

Figure 6:
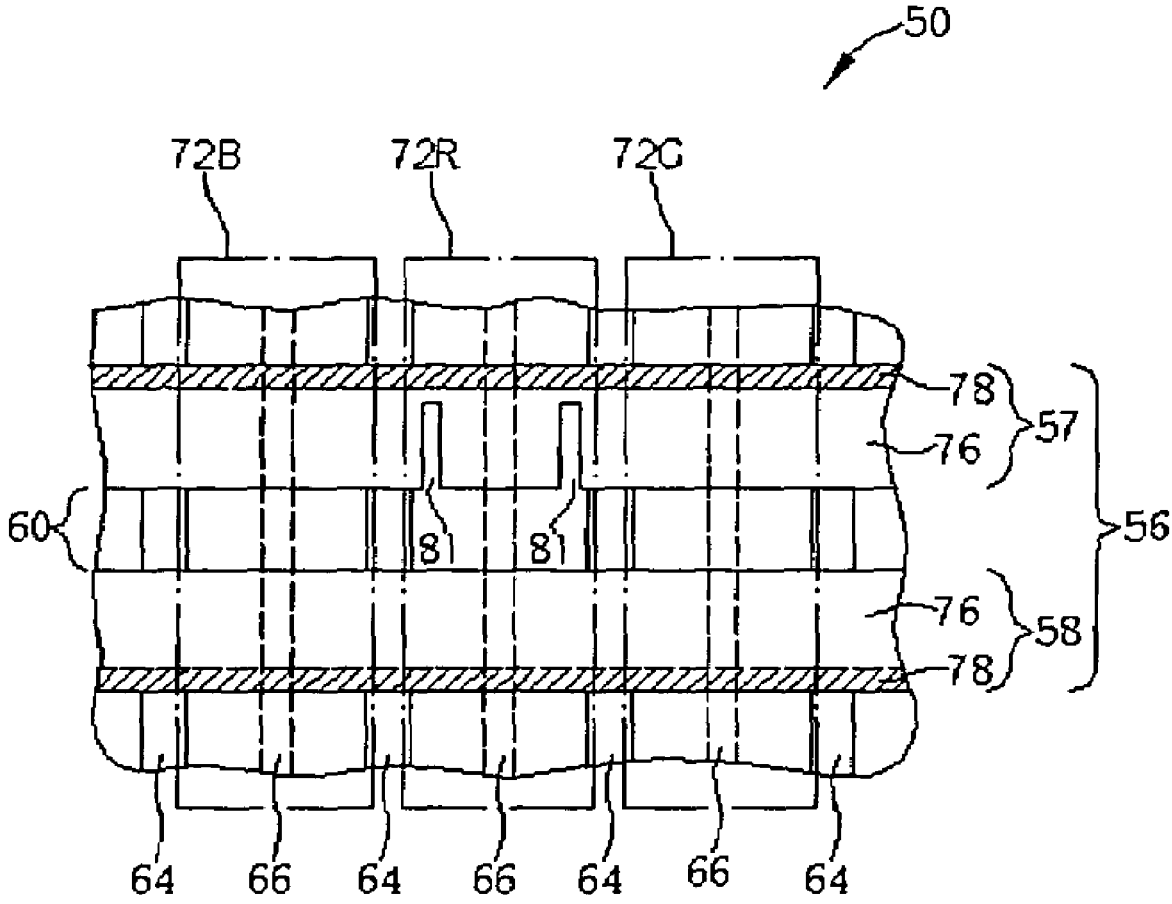
FIG. 6 is a top view of a plasma display panel according to the third preferred embodiment of the present invention.

In the third preferred embodiment of the present invention, the recessed portion 81 is only formed inside the transparent sustaining electrode 76 in the common electrode 57. As shown in FIG. 6, at least one recessed portion 81 is formed in the common electrode 57 in the second display cell 72R. Each recessed portion 81, extending from one side of the discharge gap 60 along the second direction, is formed inside the transparent sustaining electrode 76 at either side of the common electrode 57 nearby the barrier ribs 64. When each of the display cells is illuminated, an operational voltage needs to be input to make the sum of the potential difference between the scanning electrode 58 and the common electrode 57 and the potential difference between the scanning electrode 58 and the data electrode 66 greater than the firing voltage of the fluorescent material. The recessed portion 81 is only formed inside the transparent sustaining electrode 76 in the common electrode 57 to avoid the discrepancy of the operational voltage input by the scanning electrode 58 in each display cell.

Figure 7:
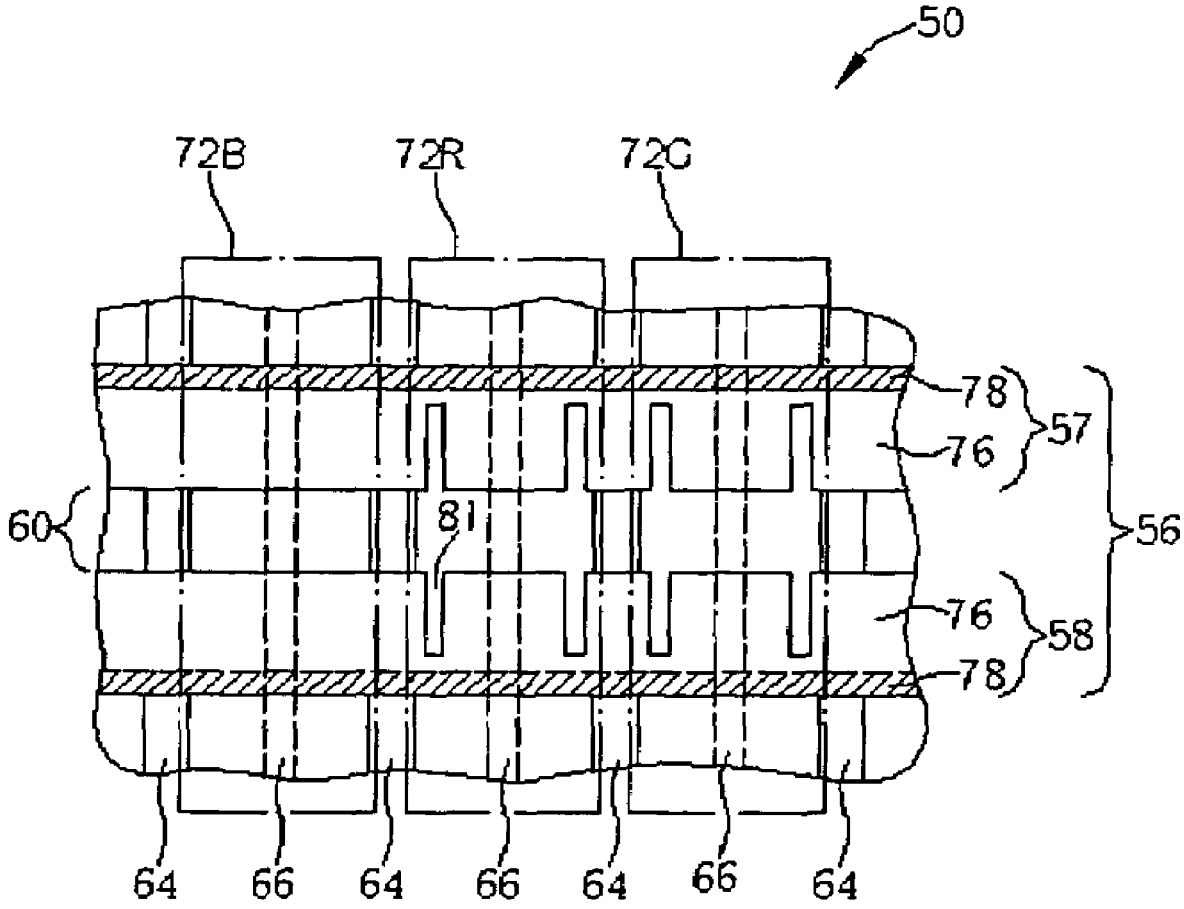
FIG. 7 is a top view of a plasma display panel according to the fourth preferred embodiment of the present invention.

The recessed portion 81 described in the first, the second, and the third preferred embodiments of the present invention can not only be formed in the second display cell 72R, but is also formed in the third display cell 72G. As shown in FIG. 7, four recessed portions 81 are respectively formed in the electrode pair 56 in the second display cell 72R and the third display cell 72G according to the fourth preferred embodiment of the present invention. Each recessed portion 81, extending from one side of the discharge gap 60 along the second direction, is formed inside the transparent sustaining electrode 76 at either side of the common electrode 57 and the scanning electrode 58 nearby the barrier ribs 64. The discharge areas for the electrode pairs 56 in the second display cell 72R and the third display cell 72G are thus decreased to reduce the luminosity of the red light emitted from the second display cell 72R and the luminosity of the green light emitted from the third display cell 72G so that the color temperature of the plasma display panel 50 is increased.

Figure 8:
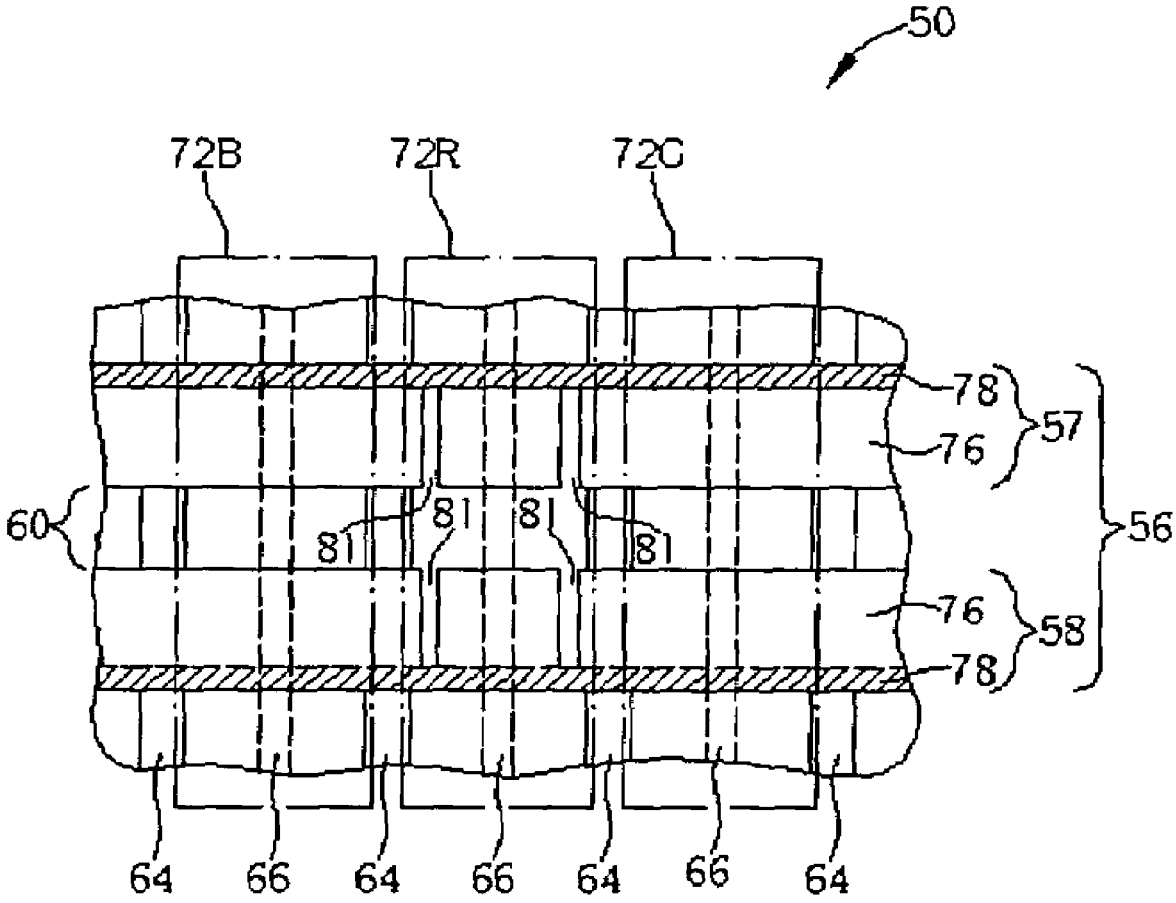
FIG. 8 is a top view of a plasma display panel according to the fifth preferred embodiment of the present invention.

In order to simplify the manufacturing process, the recessed portion 81 described in the first, the second, and the third preferred embodiments may extend to the bus electrode 78 formed on a surface of a side of the transparent sustaining electrode 76 facing the discharge gap 60. As shown in FIG. 8, four recessed portions 81 are formed in the electrode pair 56 in the second display cell 72R according to the fifth preferred embodiment of the present invention. Each recessed portion 81, extending from one side of the discharge gap 60 to the bus electrode 78 along the second direction, is formed inside the transparent sustaining electrode 76 at either side of the common electrode 57 and the scanning electrode 58 nearby the barrier ribs 64 of the second display cell 72R. Therefore, the transparent sustaining electrodes 76 in the common electrode 57 and in the scanning electrode 58 in the second display cell 72R present as a segment type.

As compared to the prior art plasma display panel, the present invention plasma display panel comprises at least one recessed portion in the electrode pairs in the display cells for emitting red light and green light to decrease the discharge areas for the electrode pairs in the display cells for emitting red light and green light. The luminosity of the red light and the green light emitted from these display cells is therefore reduced to increase the color temperature of the plasma display panel. Due to the equal space between the adjacent barrier ribs in the present invention plasma display panel, the discharge space for each of the display cell is the same to avoid the manufacturing accuracy problem that is difficult to be overcome and the discrepancy problem of the operational voltage in the prior art plasma display panel. In addition, to decrease the discharge area for the electrode pairs in the display cells for emitting red light and green light will lower the current so that the luminosity of specific color is reduced in the present invention plasma display panel while the luminous efficiency is not reduced.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma display panel (PDP) comprising:

a rear plate;

a front plate parallel with and spaced apart from the rear plate;

a plurality of transparent electrode pairs, each electrode pair comprising a common electrode and a scanning electrode disposed in parallel on a bottom surface of the front plate along a first direction, a discharge gap being formed between the common electrode and the scanning electrode, one non-transparent bus electrode being formal on a surface of a side of the common electrode facing the discharge gap, and another non-transparent bus electrode being formed on a surface of a side of the scanning electrode facing the discharge gap;

a plurality of data electrodes, each data electrode disposed in parallel on a top surface of the rear plate along a second direction;

a plurality of ribs disposed in parallel and spaced from each other by a predetermined distance on the top surface of the rear plate along the second direction; and a plurality of display cells defined at an intersection of each data electrode and each electrode pair, each display cell being partitioned by two adjacent ribs;

wherein the plurality of display cells comprise at least a first display cell for displaying blue light, a second display cell for displaying red light and a third display cell the displaying green light, and at least one recessed portion is formed in the electrode pair in the second display cell extending from one side of the discharge gap between the electrode pair along the second direction, the entire recessed portion being positioned inside the second display cell but not positioned above any of the ribs.

2. The plasma display panel of claim 1 wherein the recessed portion extends from one side of the discharge gap between the electrode pair to the bus electrode.

3. The plasma display panel of claim 1 wherein the recessed portion is formed at either side of the common electrode and the scanning electrode nearby the rib along the second direction.

4. The plasma display panel of claim 1 wherein the entire recessed portion is formed inside the common electrode and the scanning electrode, and the recessed portion is positioned right above the data electrode along the second direction.

5. The plasma display panel of claim 1 wherein the recessed portion is formed at either side of the common electrode nearby the ribs along the second direction.

6. The plasma display panel of claim 1 wherein the entire recessed portion is formed inside the common electrode, and the recessed portion is positioned right above the data electrode along the second direction.

7. The plasma display panel of claim 1 wherein at least one recessed portion extending from one side of the discharge gap between the electrode pair along the second direction is formed in the electrode pair inside the third display cell but the entire recessed portion being not positioned above any of the ribs.

8. The plasma display panel of claim 7 wherein the recessed portion extends from one side of the discharge gap between the electrode pair to the bus electrode.

9. The plasma display panel of claim 7 wherein the recessed portion is formed at either side of the common electrode and the scanning electrode nearby the rib along the second direction.

10. The plasma display panel of claim 7 wherein the entire recessed portion is formed inside the common electrode and the scanning electrode, and the recessed portion is positioned right above the data electrode along the second direction.

11. The plasma display panel of claim 7 wherein the recessed portion is formed at either side of the common electrode nearby the ribs along the second direction.

12. The plasma display panel of claim 7 wherein the entire recessed portion is formed inside the common electrode, and the recessed portion is positioned right above the data electrode along the second direction.

13. The plasma display panel of claim 1 wherein the second direction is orthogonal to the first direction.

14. The plasma display panel of claim 1 wherein the electrode pairs have different shapes among the display cells in the proximity of the discharge gap.

15. A plasma display panel (PDP) comprising:

a rear plate;

a front plate parallel with and spaced apart from the rear plate;

a plurality of transparent electrode pairs, each electrode pair comprising a common electrode and a scanning electrode disposed in parallel on a bottom surface of the front plate along a first direction, a discharge gap being formed between the common electrode and the scanning electrode, one non-transparent bus electrode being formed on a surface of a side of the common electrode facing the discharge gap, and another non-transparent bus electrode being formed on a surface of a side of the scanning electrode facing the discharge gap;

a plurality of data electrodes, each data electrode disposed in parallel on a top surface of the rear plate along a second direction;

a plurality of ribs disposed in parallel and spaced from each other by a predetermined distance on the top surface of the rear plate along the second direction; and a plurality of display cells defined at an intersection of each data electrode and each electrode pair, each display cell being partitioned by two adjacent ribs;

wherein the plurality of display cells comprise at least a first display cell for displaying blue light, a second display cell for displaying red light and a third display cell for displaying green light, at least one recessed portion is formed in the electrode pair inside the second display cell extending from one side of the discharge gap between the electrode pair along the second direction, and the entire recessed portion is not formed in the electrode pair in the first display cell and above any of the ribs.

16. The plasma display panel of claim 15 wherein the electrode pairs inside the second display cells have different shapes in the proximity of the discharge gap from that of the electrode pairs inside the first display cells.

* * * * *